US011561500B2

(12) United States Patent
Ise et al.

(10) Patent No.: US 11,561,500 B2
(45) **Date of Patent: *Jan. 24, 2023**

(54) WASTE TONER STORAGE CONTAINER AND IMAGE FORMING APPARATUS THAT DETECTS AN AMOUNT OF WASTE TONER

(71) Applicant: TOSHIBA TEC KABUSHIKI KAISHA, Tokyo (JP)

(72) Inventors: Tokihiko Ise, Tagata Shizuoka (JP); Hiroki Sakurada, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/483,867

(22) Filed: Sep. 24, 2021

(65) Prior Publication Data

US 2022/0011717 A1 Jan. 13, 2022

Related U.S. Application Data

(63) Continuation of application No. 16/952,204, filed on Nov. 19, 2020, now Pat. No. 11,150,596.

(30) Foreign Application Priority Data

Mar. 25, 2020 (JP) ..... JP2020-054553

(51) Int. Cl.
*G03G 21/10* (2006.01)
*G03G 21/12* (2006.01)

(52) U.S. Cl.
CPC ..... *G03G 21/12* (2013.01); *G03G 21/105* (2013.01)

(58) Field of Classification Search
CPC ..... G03G 21/12; G03G 21/105
(Continued)

(56) References Cited

U.S. PATENT DOCUMENTS 8,639,132 B2 1/2014 Sato et al.
8,824,905 B2 9/2014 Kitagawa
(Continued)

FOREIGN PATENT DOCUMENTS

JP 01-149662 10/1989
JP 04-254879 9/1992
(Continued)

OTHER PUBLICATIONS

Ex Parte Quayle Action for U.S. Appl. No. 16/952,204 dated May 4, 2021.
(Continued)

*Primary Examiner* — William J Royer
(74) *Attorney, Agent, or Firm* — Amin, Turocy & Watson, LLP

(57) ABSTRACT

A waste toner storage container includes a container body, a toner storage chamber, and a paddle. The toner storage chamber includes an introduction port, a first space, and a second space. The introduction port receives waste toner. The first space stores the introduced waste toner, and extends in a first direction. The second space is disposed in an end portion of the first space in a second direction orthogonal to the first direction. The paddle includes a shaft, a first plate, and a second plate. The shaft is disposed in the first space, extends along the first direction, and is elongated. The first plate is formed on an outer peripheral surface around a central axis of the shaft, and conveys the waste toner in the first direction. The second plate is formed on the outer peripheral surface of the shaft, and conveys the waste toner toward the second space.

20 Claims, 7 Drawing Sheets

(58) Field of Classification Search
USPC ..... 399/35, 358, 360
See application file for complete search history.

(56) References Cited

U.S. PATENT DOCUMENTS

| | | | | |
|---|---|---|---|---|
| 8,855,511 | B2 | 10/2014 | Kitagawa | |
| 10,474,089 | B2 | 11/2019 | Furukawa | |
| 11,150,596 | B1 * | 10/2021 | Ise et al. ..... | G03G 21/12 |
| 2019/0011854 | A1 | 1/2019 | Suenaga et al. | |
| 2021/0080894 | A1 | 3/2021 | Ise | |

FOREIGN PATENT DOCUMENTS

| | | |
|---|---|---|
| JP | 2006-178143 | 7/2006 |
| JP | 2016-186605 | 10/2016 |

OTHER PUBLICATIONS

Extended European Search Report for European Patent Application No. 20216037.0 dated Jun. 7, 2021.

* cited by examiner

WASTE TONER STORAGE CONTAINER AND IMAGE FORMING APPARATUS THAT DETECTS AN AMOUNT OF WASTE TONER

CROSS-REFERENCE TO RELATED APPLICATIONS

This application is a Continuation of application Ser. No. 16/952,204 filed on Nov. 19, 2020, the entire contents of which are incorporated herein by reference.

This application is based upon and claims the benefit of priority from. Japanese Patent Application No. 2020-054553, filed on Mar. 25, 2020, the entire contents of which are incorporated herein by reference.

FIELD

Embodiments described herein relate generally to a waste toner storage container and an image forming apparatus.

BACKGROUND

In an image forming apparatus such as multi-function-peripherals (MFP), printers, and copying machines, printing is performed by fixing toner onto a printing paper, a cleaner blade scrapes toner remaining on a surface of a photoconductive drum or on an intermediate transfer belt so that the toner is collected in a waste toner storage container. In order to prevent a possibility that the collected toner (hereinafter, referred to as "waste toner") may overflow from the waste toner storage container and scattering into a main body of the image forming apparatus, the amount of the waste toner inside the waste toner storage container is monitored by waste toner detection means.

For example, according to the waste toner detection means in the related art, a stirring member is provided inside the waste toner storage container to smooth a liquid level of the waste toner accumulated in the waste toner storage container. In this manner, the waste toner detection means prevents false detection of the amount of the waste toner inside the waste toner storage container.

However, according to the waste toner detection means in the related art, depending on a storage state of the waste toner inside the waste toner storage container, there is a possibility that the waste toner detection means may not be able to accurately detect the amount of the waste toner inside the waste toner storage container.

DETAILED DESCRIPTION

Exemplary embodiments provide a waste toner storage container and an image forming apparatus which are capable of accurately detecting the amount of waste toner inside a waste toner storage container regardless of a storage state of the waste toner.

The waste toner storage container according to an exemplary embodiment includes a container body, a toner storage chamber, and a paddle. The toner storage chamber includes an introduction port, a toner storage space, and a nearly full state detection space. The introduction port is provided in the container body to receive the waste toner. The toner storage space stores the waste toner introduced through the introduction port, and extends in a first direction. The nearly full state detection space is disposed in an end portion of the toner storage space in a second direction orthogonal to the first direction, and communicates with the toner storage space. The paddle includes a shaft, a first plate, and a second plate. The shaft is disposed in the toner storage space, extends along the first direction, and is elongated. The first plate is formed on an outer peripheral surface around a central axis of the shaft, and conveys the waste toner in the first direction. The second plate is formed on the outer peripheral surface of the shaft, and conveys the waste toner toward the nearly full state detection space.

Hereinafter, the waste toner storage container and the image forming apparatus according to an embodiment will be described with reference to the drawings.

In the present application, an X-direction, a Y-direction, and a Z-direction will be defined as follows. The Y-direction is a width direction (rotation axis direction) of a photoconductive drum. The Z-direction is a vertically upward-downward direction. The X-direction is a horizontal direction, and is a direction perpendicular to the Y-direction and the Z-direction.

Figure 1:
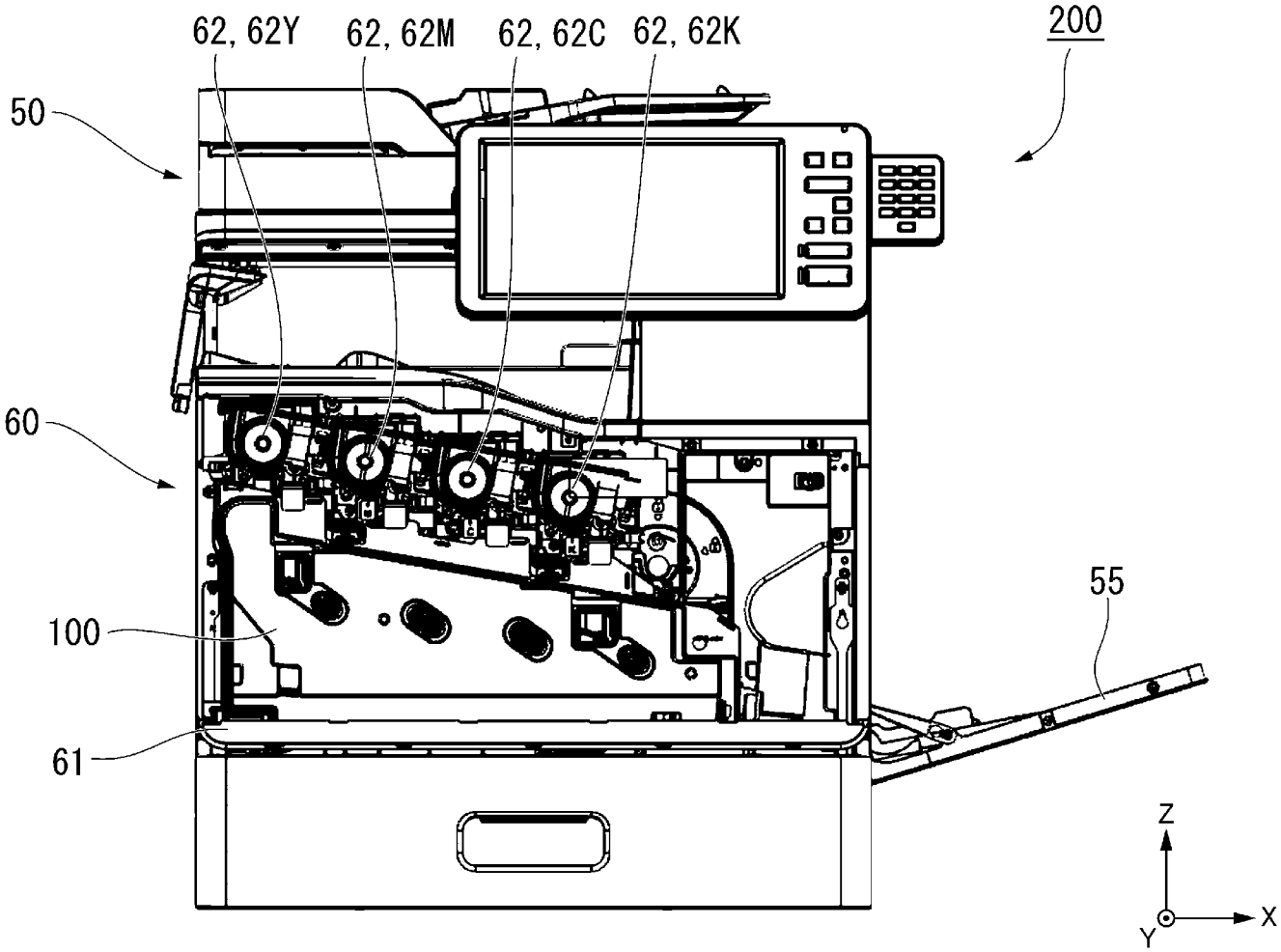
FIG. 1 is an overall configuration diagram of an image forming apparatus according to an embodiment.

FIG. 1 is an overall configuration diagram of an image forming apparatus 200 according to an embodiment.

The image forming apparatus 200 according to a first embodiment is an MFP, a printer, or a copying machine, for example. Hereinafter, a case where the image forming apparatus 200 is the MFP as illustrated in FIG. 1 will be described as an example.

Figure 2:
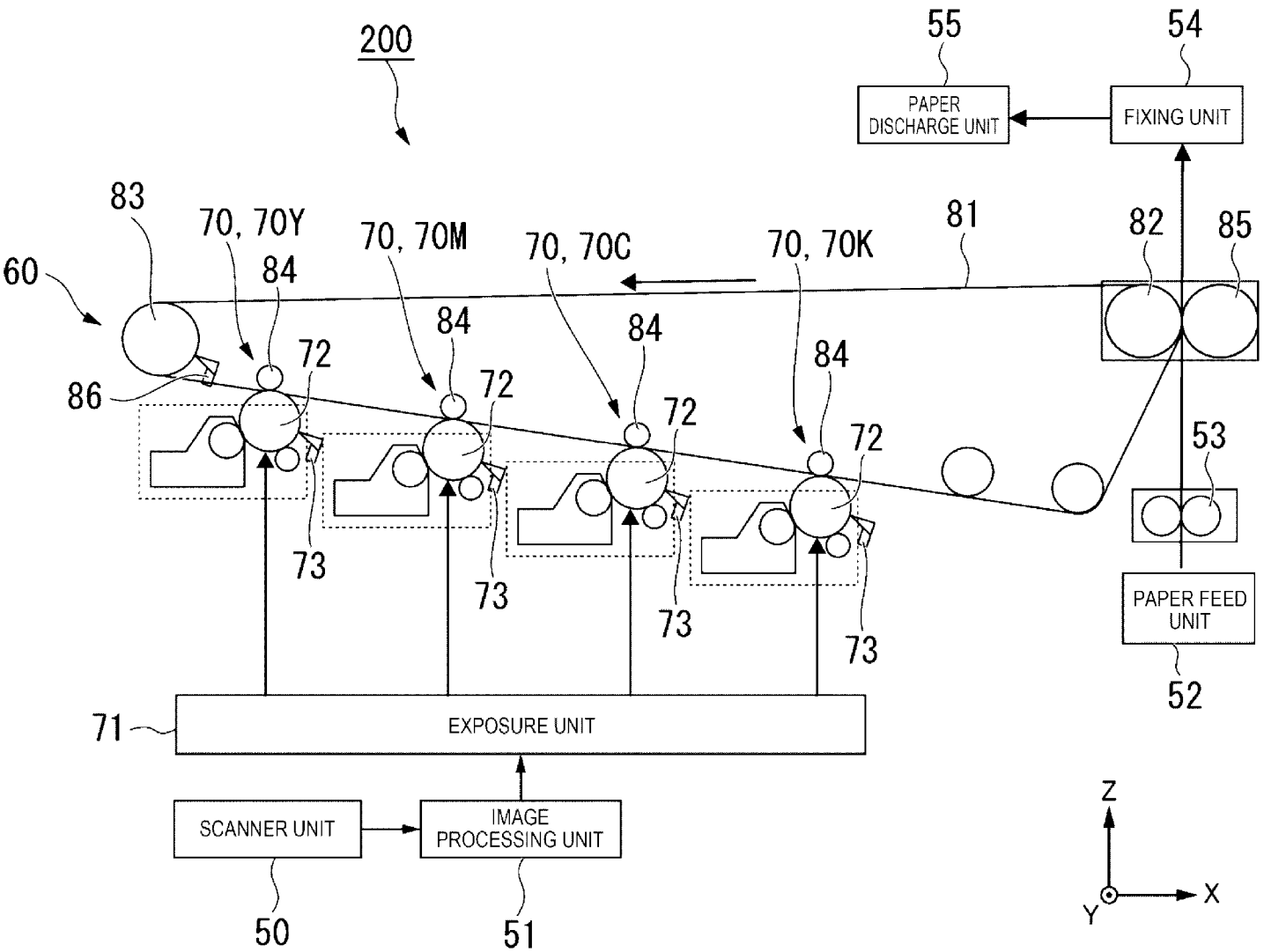
FIG. 2 is a functional configuration diagram.

FIG. 2 is a functional configuration diagram of the image forming apparatus 200.

The image forming apparatus 200 includes a scanner unit 50, an image processing unit 51, a printer unit 60, a paper feed unit 52, a registration roller 53, a fixing unit 54, and a paper discharge unit 55.

The scanner unit 50 reads an image formed on a sheet serving as a scanning target. For example, the scanner unit 50 reads the image on the sheet, and generates image data of three primary colors of red (R), green (G), and blue (B). The scanner unit 50 outputs the generated image data to the image processing unit 51.

The image processing unit 51 converts the image data generated by the scanner unit 50 or the image data generated by a personal computer into a color signal of each color. For example, the image processing unit 51 converts the image data into image data (color signal) of four colors of yellow (Y), magenta (M), cyan (C), and black (K). The image processing unit 51 controls an exposure unit 71 based on the color signal of each color.

The paper feed unit 52 feeds sheets one by one to the registration roller 53 at a timing at which the printer unit 60 forms a toner image.

The registration roller 53 adjusts a position of a leading edge of the sheet in a conveyance direction by bending the sheet with a nip. The registration roller 53 conveys the sheet in accordance with a timing at which the printer unit 60 transfers the toner image to the sheet.

The fixing unit 54 applies heat and pressure to the sheet to fix the transferred toner image onto the sheet. The fixing unit 54 discharges the sheet to the paper discharge unit 55.

The paper discharge unit 55 places the discharged sheet. For example, the paper discharge unit 55 is a paper discharge tray.

The printer unit 60 forms an output image (hereinafter, referred to as a toner image) by using toner (developer), based on the image data received from the image processing unit 51. The printer unit 60 transfers the toner image to a surface of the sheet. The printer unit 60 includes a toner cartridge 62, an image forming unit 70, a transfer unit, and a waste toner storage container 100.

As illustrated in FIG. 1, the printer unit 60 includes a front cover 61 as an exterior cover. The front cover 61 can be opened and closed. If the front cover 61 is open, an operator can attach and detach various device parts provided to be attachable and detachable inside the printer unit 60. For example, the operator can open the front cover 61, and can attach and detach the toner cartridge 62 or the waste toner storage container 100.

The toner cartridge 62 supplies the toner to the image forming unit 70. A plurality of toner cartridges 62Y, 62M, 62C, and 62K are disposed along the X-direction. The plurality of toner cartridges 62Y, 62M, 62C, and 62K respectively supply yellow, magenta, cyan, and black toners.

As illustrated in FIG. 2, the image forming unit 70 includes the exposure unit 71, a photoconductive drum 72, and a photoconductive cleaner 73. Four image forming units 70Y, 70M, 70C, and 70K are disposed along an intermediate transfer belt 81. The four image forming units 70Y, 70M, 70C, and 70K respectively form toner images by using the yellow, magenta, cyan, and black toners. The four image forming units 70Y, 70M, 70C, and 70K are arranged parallel to each other. In addition, in the four image forming units 70Y, 70M, 70C, and 70K, the image forming unit 70Y is disposed at a highest position in a vertical direction (Z-direction). The image forming units 70Y, 70M, 70C, and 70K are disposed in this order at lower positions.

The exposure unit 71 performs an exposure process for scanning and exposing a surface of the photoconductive drum 72, based on the image data received from the image processing unit 51. The exposure unit 71 includes a scanning optical system. The scanning optical system includes a light source and a polygon mirror (deflector). For example, the light source is a laser light source or an LED light source. While rotating, the polygon mirror reflects light emitted from the light source. In this manner, the exposure unit 71 scans and exposes the surface of the photoconductive drum 72. In an exposed portion of the surface of the photoconductive drum 72, a negative charge disappears. In this manner, an electrostatic latent image based on the image data is formed on the surface of the photoconductive drum 72.

The photoconductive drum 72 is an image carrier that carries the electrostatic latent image. The photoconductive drum 72 is formed in a cylindrical shape. The charged toner is supplied to the surface of the photoconductive drum 72 so that the electrostatic latent image is developed. The toner image formed on the surface of the photoconductive drum 72 is primarily transferred to the intermediate transfer belt 81.

The photoconductive cleaner 73 performs a cleaning process for removing the toner remaining on the surface of the photoconductive drum 72. The photoconductive cleaner 73 includes a first waste toner discharge pipe 74 for discharging the removed toner to the waste toner storage container 100. Four first waste toner discharge pipes 74Y, 74M, 74C, and 74K are independently provided for each of the four image forming units 70Y, 70M, 70C, and 70K.

The transfer unit sequentially and primarily transfers each toner image formed on the surface of each photoconductive drum 72, thereby forming a primary transfer image of each color toner. Furthermore, the transfer unit secondarily transfers the primary transfer image onto a sheet, thereby forming the toner image on the sheet. As illustrated in FIG. 2, the transfer unit includes the intermediate transfer belt 81, a driving roller 82, a driven roller 83, a primary transfer roller 84, a secondary transfer roller 85, and an intermediate transfer belt cleaner 86.

The intermediate transfer belt 81 is stretched to be horizontally long by the driving roller 82 and a plurality of the driven rollers 83. The driving roller 82 is driven to rotate by a drive motor (not illustrated). If the driving roller 82 is driven, the intermediate transfer belt 81 cyclically moves. A linear velocity of the intermediate transfer belt 81 is adjusted to a predetermined process linear velocity. A portion of the surface of the intermediate transfer belt 81 is in contact with each upper side top portion of the respective photoconductive drums 72.

Primary transfer rollers 84 are respectively disposed at positions facing the respective photoconductive drums 72 inside the intermediate transfer belt 81. If a primary transfer voltage is applied, the primary transfer roller 84 primarily transfers the toner image on the photoconductive drum 72 to the intermediate transfer belt 81.

The secondary transfer roller 85 faces the driving roller with the intermediate transfer belt 81 interposed therebetween. A secondary transfer voltage is applied to the secondary transfer roller 85 when the sheet passes between the driving roller 82 and the secondary transfer roller 85. If the secondary transfer voltage is applied, the secondary transfer roller 85 secondarily transfers the toner image on the intermediate transfer belt 81 to the sheet.

The intermediate transfer belt cleaner 86 removes a residual transfer toner remaining on the intermediate transfer belt 81 without being secondarily transferred to the sheet, from the intermediate transfer belt 81. For example, the intermediate transfer belt cleaner 86 includes a cleaning blade that comes into contact with the intermediate transfer belt 81. The cleaning blade removes the residual toner on the surface of the intermediate transfer belt 81. The intermediate transfer belt cleaner 86 includes a second waste toner discharge pipe 87 for discharging the removed toner to the waste toner storage container 100.

Figure 3:
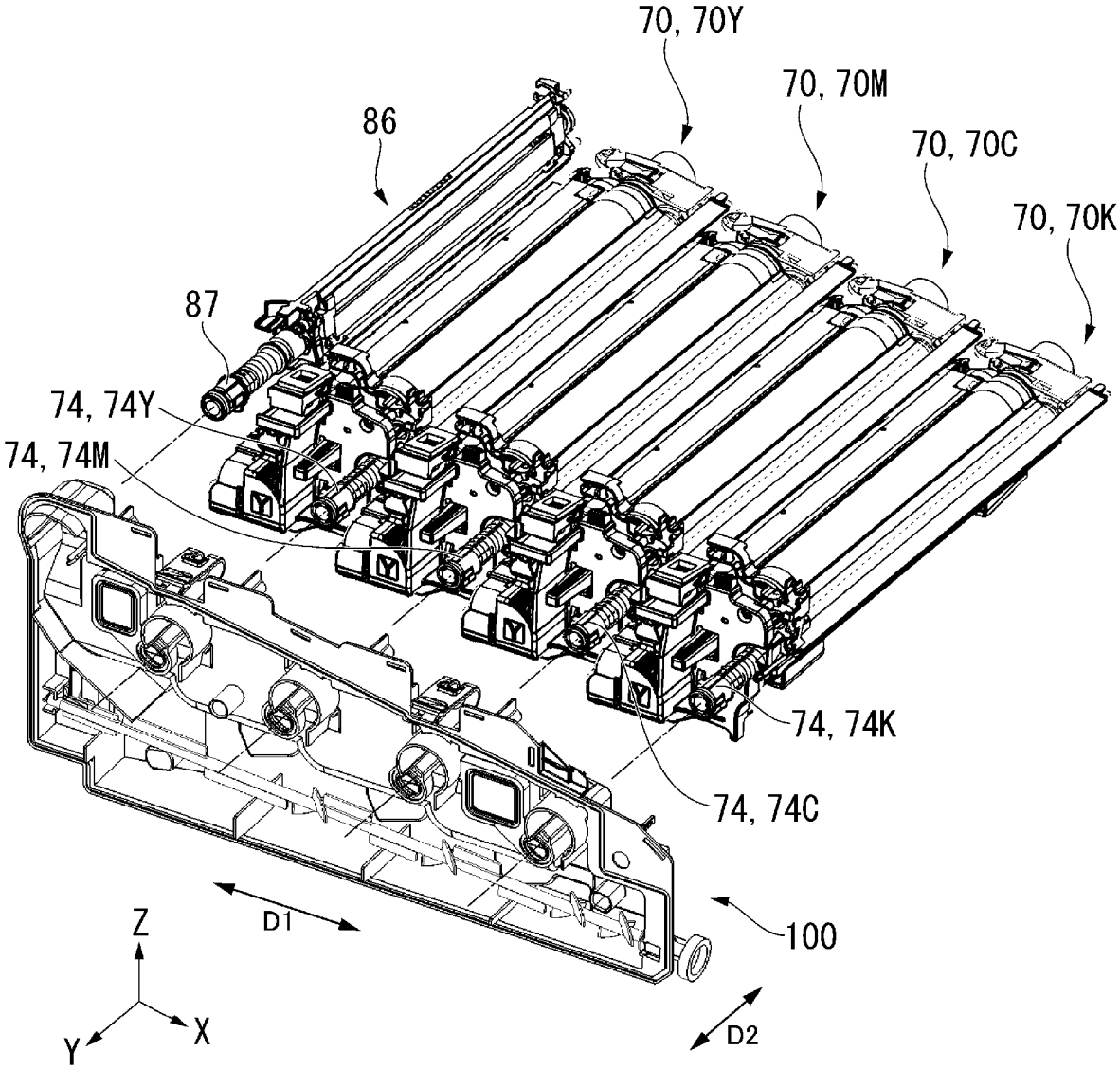
FIG. 3 is an exploded view of a part of a printer unit.

FIG. 3 is an exploded view of a part of the printer unit 60.

The waste toner storage container 100 stores the waste toner discharged from the photoconductive cleaner 73 and the intermediate transfer belt cleaner 86. The waste toner is fed into the waste toner storage container 100 from each end portion of the four first waste toner discharge pipes 74Y, 74M, 74C, and 74K connected to the photoconductive cleaner 73. In addition, the waste toner is also fed into the waste toner storage container 100 from an end portion of the second waste toner discharge pipe 87 connected to the intermediate transfer belt cleaner 86.

The four first waste toner discharge pipes 74Y, 74M, 74C, and 74K and the second waste toner discharge pipe 87 are arranged parallel to each other in the Y-direction. In addition, the four first waste toner discharge pipes 74Y, 74M, 74C, and 74K and the second waste toner discharge pipe 87 are arranged in the order of the second waste toner discharge pipe 87, the first waste toner discharge pipes 74Y, 74M, 74C, and 74K in the horizontal direction (X-direction). In addition, in the four first waste toner discharge pipes 74Y, 74M, 74C, and 74K and the second waste toner discharge pipe 87, the second waste toner discharge pipe 87 is disposed at the highest position in the vertical direction (Z-direction). The second waste toner discharge pipe 87 and the first waste toner discharge pipes 74Y, 74M, 74C, and 74K are disposed in this order at lower positions.

In the following description, in the horizontal direction (X-direction), a direction in which the second waste toner discharge pipe 87 is located will also be referred to as a "leftward direction", and a direction in which the first waste toner discharge pipe 74K is located will also be referred to as a "rightward direction".

Figure 4:
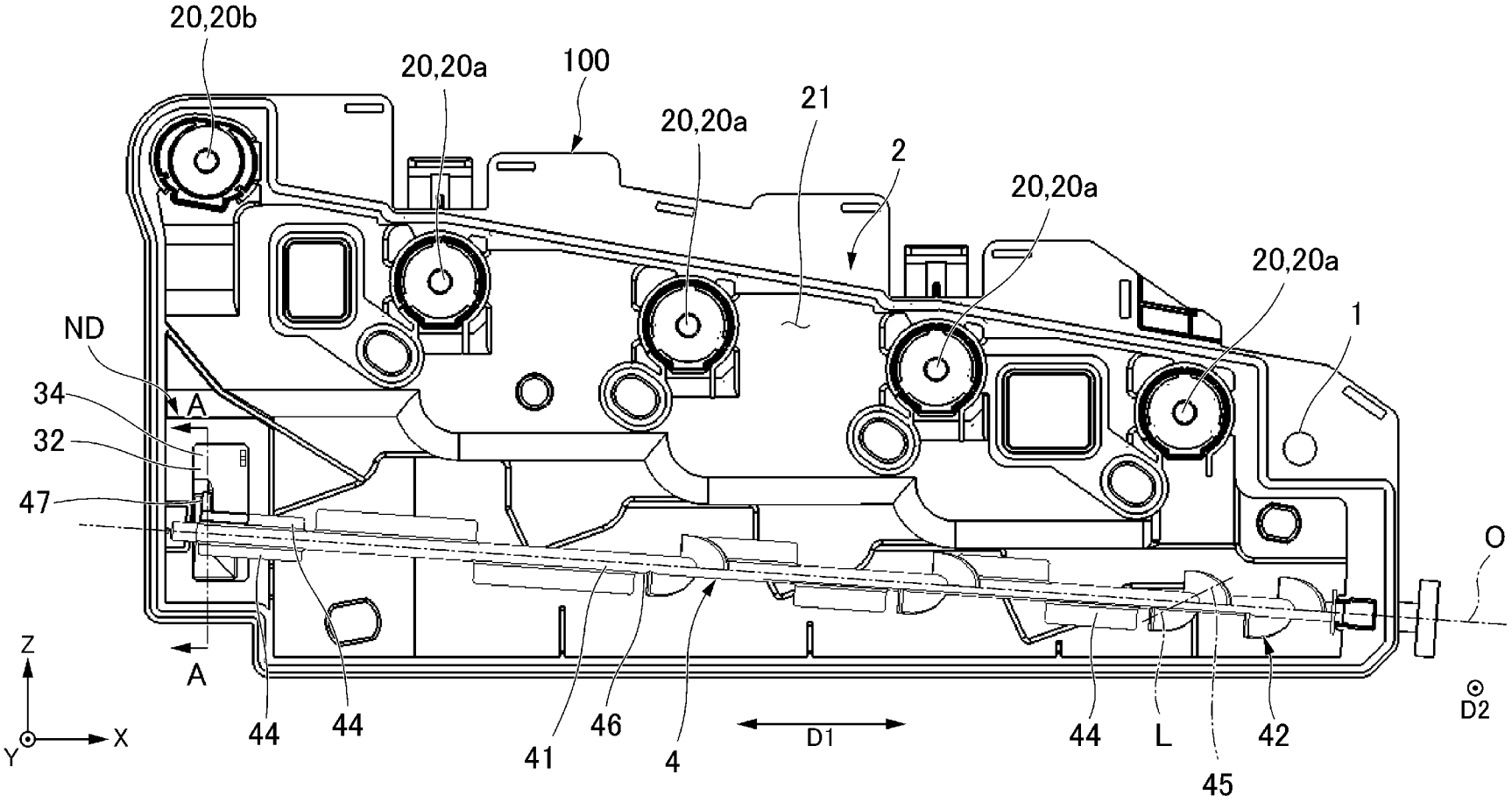
FIG. 4 is a front view of a waste toner storage container.

FIG. 4 is a front view of the waste toner storage container 100. For example, the waste toner storage container 100 includes a container body 1, a toner storage chamber 2, and a paddle 4. As illustrated in FIG. 1, the waste toner storage container 100 is provided to be attachable and detachable by a user, on a front side of the image forming apparatus 200 whose front cover is open.

Figure 5:
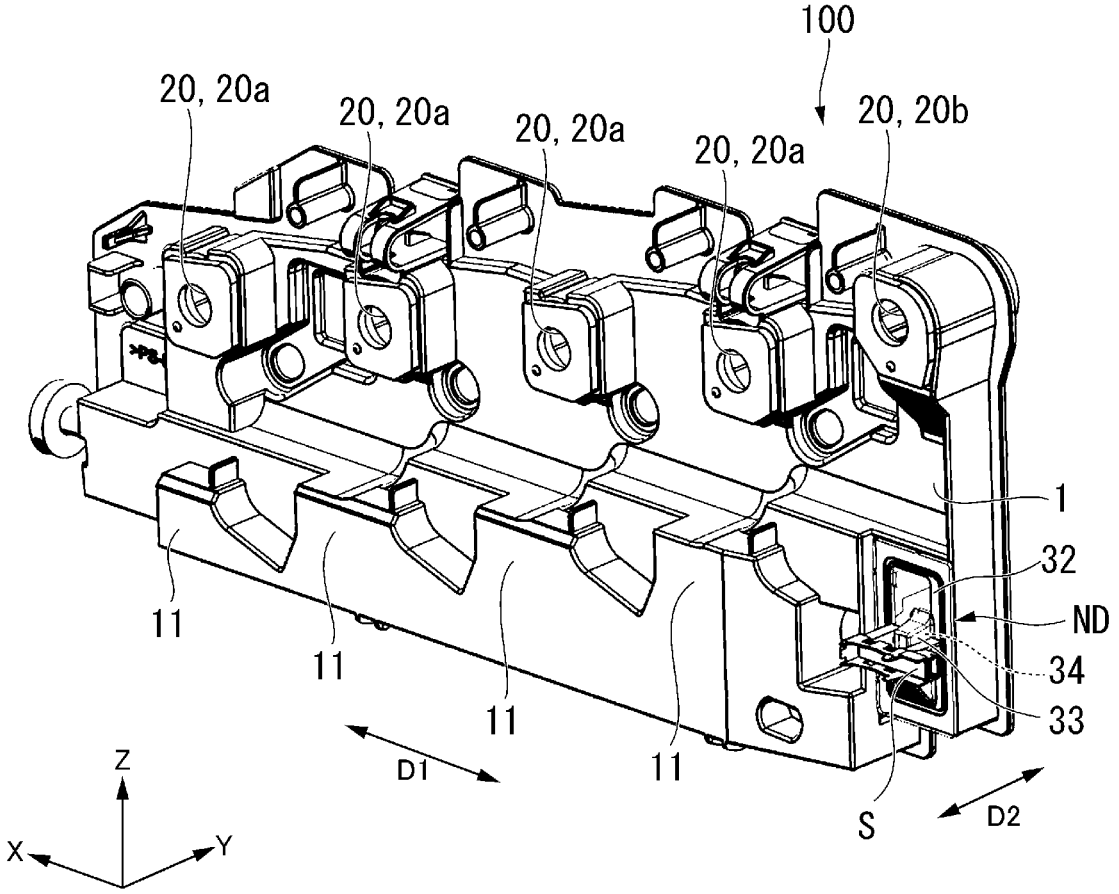
FIG. 5 is a perspective view when the waste toner storage container is viewed from an opposite side.

FIG. 5 is a perspective view when the waste toner storage container 100 illustrated in FIG. 4 is viewed from an opposite side. The container body 1 is a substantially rectangular parallelepiped housing that is long in the X-direction and thin in the Y-direction. The container body 1 is formed of a transparent or translucent material, and a waste toner T accumulated inside the container body 1 can be visually recognized. In order to increase a storage volume of the waste toner of the container body 1, the container body 1 includes a plurality of protrusion portions 11 protruding in the Y-direction within a range that the container body 1 can be stored in the image forming apparatus 200.

As illustrated in FIG. 4, the toner storage chamber 2 is provided in the container body 1, and has an introduction port 20, a toner storage space 21, and a nearly full state detection unit ND.

The introduction port 20 is an opening through which the waste toner T is received into the toner storage space 21. The introduction port 20 includes four first introduction ports 20*a* and one second introduction port 20*b*. Each of the introduction ports 20 is open in the Y-direction, and the waste toner T is discharged from the introduction port 20 in the Y-direction.

The first introduction port 20*a* is an opening through which the waste toner T is received into the toner storage space 21 from the four first waste toner discharge pipes 74 connected to the photoconductive cleaner 73. The four first waste toner discharge pipes 74 connected to the photoconductive cleaner 73 included in the four image forming units 70Y, 70M, 70C, and 70K are respectively connected to the four first introduction ports 20*a*. The toner removed from the surface of the photoconductive drum 72 is discharged to the toner storage space 21 from the first introduction port 20*a*.

The second introduction port 20*b* is an opening through which the waste toner is received into the toner storage space 21 from the second waste toner discharge pipe 87 connected to the intermediate transfer belt cleaner 86. The toner removed from the intermediate transfer belt cleaner 86 is discharged to the toner storage space 21 from the second introduction port 20*b*.

The toner storage space 21 stores the waste toner T introduced through the introduction port 20. The toner storage space 21 extends in a first direction D1. In the present embodiment, the first direction D1 substantially extends along the X-direction. In the toner storage space 21, a region where the plurality of protrusion portions 11 illustrated in FIG. 5 are formed has a larger storage volume of the waste toner T than a region where the protrusion portions 11 are not formed.

The nearly full state detection unit ND measures the amount of the waste toner T stored in the waste toner storage container 100. As illustrated in FIG. 4, the nearly full state detection unit ND is disposed in an end portion of the toner storage space 21 in a second direction D2 orthogonal to the first direction D1. The nearly full state detection unit ND is provided in the vicinity of an end portion of the toner storage chamber 2 in the leftward direction. In the present embodiment, the second direction D2 substantially extends along the Y-direction. The nearly full state detection unit ND includes a light passage window 32 and a nearly full state detection space 34.

Figure 6:
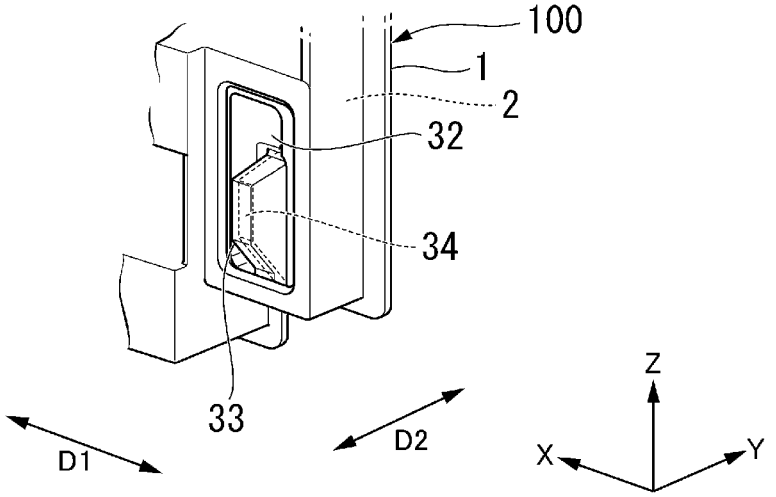
FIG. 6 is a perspective view of a light passage window in a nearly full state detection space.

FIG. 6 is a perspective view of the light passage window 32. The light passage window 32 is formed on a side surface of the container body 1 of the waste toner storage container 100 in the second direction D2. The light passage window 32 is a transparent or translucent window through which the waste toner T cannot pass and the light can pass. The light passage window 32 faces the toner storage chamber 2. The user can visually recognize the toner storage chamber 2 via the light passage window 32. The user can visually recognize the amount of the waste toner T accumulated in the toner storage chamber 2 through the light passage window 32. The light passage window 32 includes a convex portion 33 partially protruding in a direction toward an outer space of the container body 1.

The nearly full state detection space 34 is a space that communicates with the toner storage space 21, stores the waste toner T, and measures the amount of the waste toner T. The nearly full state detection space 34 is an internal space formed inside the convex portion 33. The nearly full state detection space 34 is a groove-shaped space recessed in the second direction D2 on an inner surface of the container body 1 and extending in the Z-direction. A volume of the nearly full state detection space 34 is extremely smaller than a volume of the toner storage space 21 that is a main storage space for storing the waste toner T.

Figure 7:
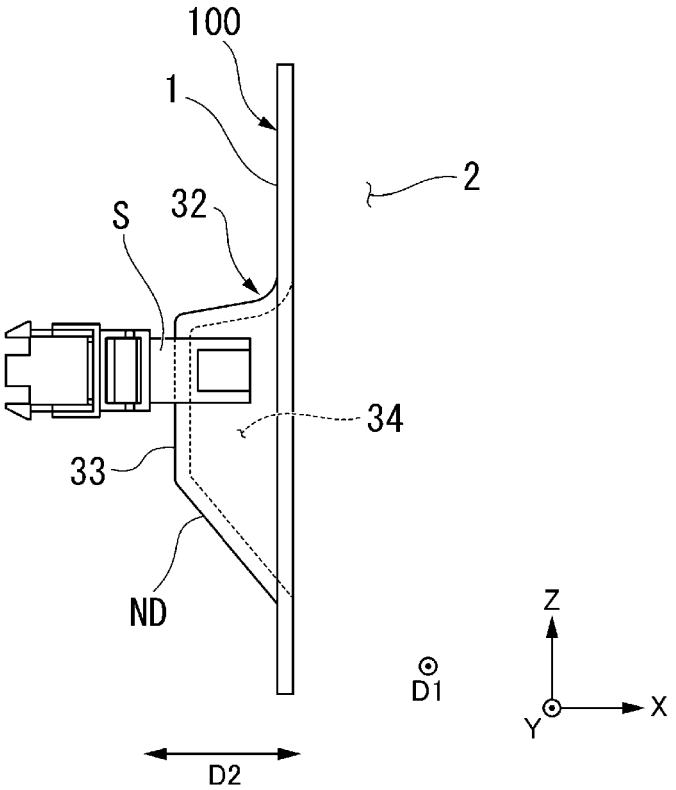
FIG. 7 is a side view of a sensor for detecting accumulation of waste toner.

FIG. 7 is a side view of a sensor S that detects accumulation of the waste toner T in the nearly full state detection space 34. For example, the sensor S is a photo interrupter, and includes a light emitting element and a light receiving element. The sensor S is disposed at a position where the convex portion 33 is interposed between the light emitting element and the light receiving element. If the waste toner T enters the nearly full state detection space 34 side, an optical path from the light emitting element to the light receiving element of the sensor S is blocked by the waste toner T. The sensor S can detect that the waste toner T enters the nearly full state detection space 34 by detecting that the optical path from the light emitting element to the light receiving element is blocked. The sensor S is not limited to the photo interrupter, and may be an image sensor or a weight sensor.

A position of the convex portion 33 or a height for installing the sensor S is adjusted. In this manner, a degree (a "full state" or a "nearly full state") of the accumulated amount of the waste toner T to be detected can be changed. The sensor S is not integrated with the waste toner storage container 100, and is provided in the image forming apparatus 200 other than the waste toner storage container 100.

As illustrated in FIG. 4, the paddle 4 includes an elongated shaft 41, a vertical conveyance blade 42, and a feed plate (second plate) 47. The paddle 4 conveys the waste toner T stored in the toner storage space 21 in the leftward direction by turning the spiral-shaped vertical conveyance blade 42 around a central axis O in a longitudinal direction of the shaft 41 which serves as a rotation axis. The paddle 4 conveys the waste toner T stored in the toner storage space 21 toward the nearly full state detection space 34 by turning the plate-shaped feed plate 47 around the central axis O in the longitudinal direction of the shaft 41 which serves as the rotation axis.

The paddle 4 is disposed so that a left side end portion is located higher than a right side end portion in the upward-downward direction (Z-direction).

The shaft 41 is formed in a shaft shape substantially extending along the first direction D1. The shaft 41 is disposed below the sensor S. The shaft 41 is connected to a rotary drive mechanism (not illustrated) provided in the image forming apparatus 200 via a member penetrating the waste toner storage container 100. Power is transmitted from the rotary drive mechanism to the shaft 41, and the shaft 41 rotates around the central axis O in the longitudinal direction.

The shaft 41 is disposed from an end portion in the rightward direction to an end portion in the leftward direction of the toner storage space 21. Therefore, the paddle 4 can convey the waste toner T introduced from all of the introduction ports 20 from the end portion in the rightward direction to the end portion in the leftward direction of the toner storage space 21.

The vertical conveyance blade 42 is provided from the end portion in the rightward direction of the toner storage space 21 to the vicinity of the nearly full state detection space 34. The vertical conveyance blade 42 includes a stirring plate (first plate) 44 and a screw (first plate) 45.

The stirring plate 44 rotates together with the shaft 41 so that the waste toner T is pushed outward in a radial direction of the shaft 41, and stirs the waste toner T. The stirring plate 44 is formed in a flat plate shape erected in the radial direction of the shaft 41. The stirring plate 44 is formed to extend in the longitudinal direction of the shaft 41.

As illustrated in FIG. 4, the stirring plate 44 is formed at a position where the protrusion portion 11 (refer to FIG. 5) is formed in the second direction D2 of the shaft 41. Even if the toner storage space 21 has a region where the protrusion portion 11 having a large storage volume of the waste toner T is formed, the stirring plate 44 stirs the waste toner T. Accordingly, a liquid level of the waste toner T stored in the toner storage space 21 can be preferably smoothed.

Figure 8:
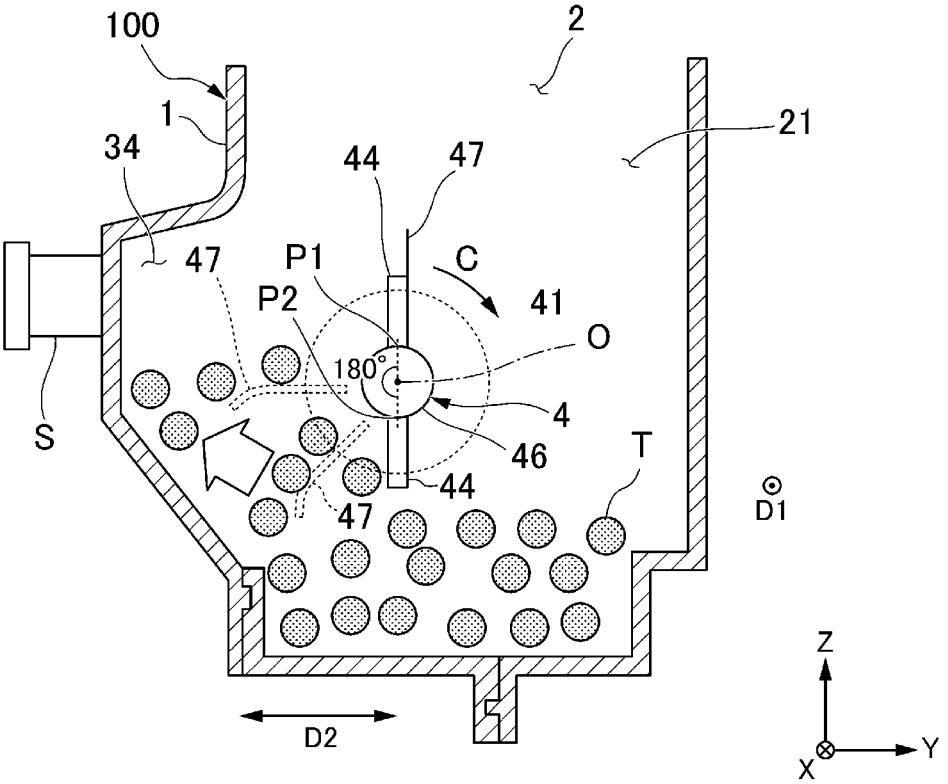
FIG. 8 is a view illustrating an operation of a paddle.

FIG. 8 is a sectional view taken along line A-A in FIG. 4. As illustrated in FIG. 8, the stirring plate 44 is located in the vicinity of the nearly full state detection space 34, and is formed at a first position P1 on one side in the radial direction and a second position P2 on the other side in the radial direction when viewed in a direction perpendicular to the central axis O, on an outer peripheral surface 46 of the shaft 41. In the present embodiment, the first position P1 and the second position P2 form an angle of 180 degrees around the central axis O.

The screw 45 rotates together with the shaft 41 so that the waste toner T is pushed in the leftward direction, and conveys the waste toner T. The screw 45 has a shape of a portion protruding from the outer peripheral surface 46 of the shaft 41 in a partial circle around a center line L intersecting with the central axis O of the shaft 41 at a predetermined angle. A pair of the screws 45 are formed at positions displaced along the central axis O and displaced in a circumferential direction of the outer peripheral surface 46. A plurality of pairs of the screws 45 are formed along the central axis O.

The feed plate 47 is provided in the vicinity of an end portion of the toner storage chamber 2 in the leftward direction. The feed plate 47 fits into the nearly full state detection space 34 if viewed in the second direction D2.

The feed plate 47 is formed in a flat plate shape erected in the radial direction of the shaft 41. The feed plate 47 is formed to extend in the longitudinal direction of the shaft 41. As illustrated in FIG. 8, the feed plate 47 is in parallel and close contact with the stirring plate 44 provided at the first position P1 along a circumferential direction C around the central axis O of the shaft 41 in the vicinity of the nearly full state detection space 34. The feed plate 47 further protrudes from the outer peripheral surface 46 of the shaft 41, compared to the stirring plate 44. The feed plate 47 further protrudes from the outer peripheral surface 46, compared to the vertical conveyance blade 42. A dimension of the feed plate 47 along the central axis O of the shaft 41 is smaller than that of the stirring plate 44. The feed plate 47 has a thickness smaller than that of the stirring plate 44. The feed plate 47 is disposed in the vicinity of the end portion in the leftward direction of the stirring plate 44. The feed plate 47 has higher elasticity than the stirring plate 44.

Figure 9:
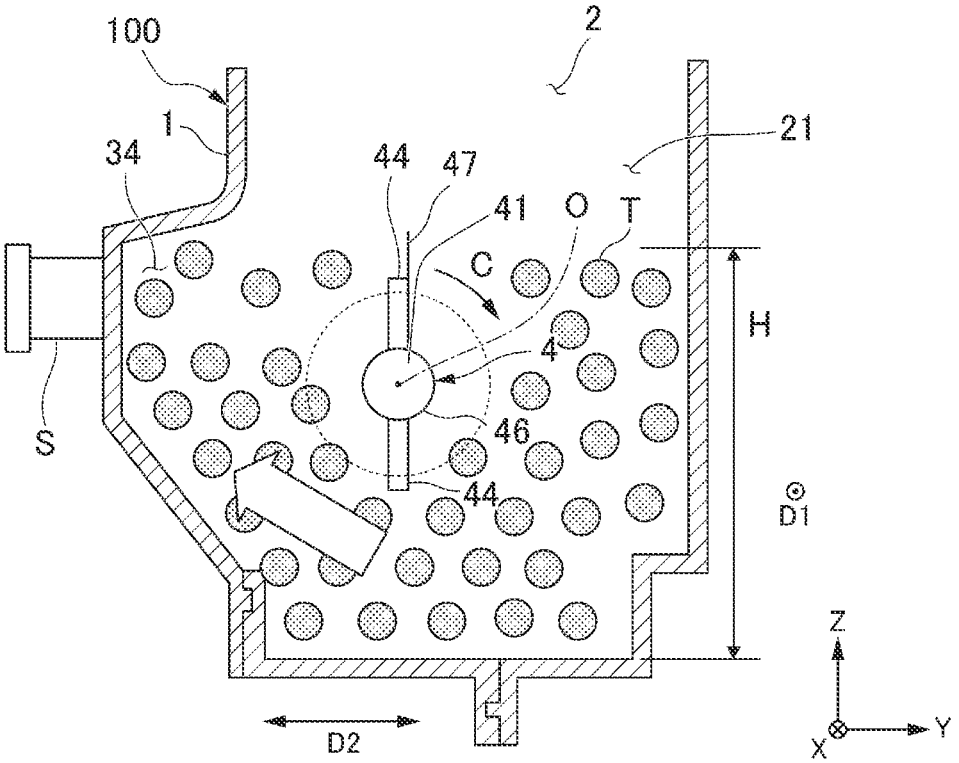
FIG. 9 is a view illustrating a nearly full state.

Next, an operation of the waste toner storage container 100 in the image forming apparatus 200 will be described. FIGS. 8 and 9 are views for describing the operation of the waste toner storage container 100.

The waste toner T stored in the toner storage space 21 is stirred by the vertical conveyance blade 42 of the paddle 4 rotated by receiving power. While being smoothed, the waste toner T is conveyed in the leftward direction from the end portion in the rightward direction of the toner storage space 21.

As illustrated in FIG. 8, the waste toner T conveyed in the leftward direction of the toner storage space 21 is collected downward of the feed plate 47. The waste toner T collected downward of the feed plate 47 eventually comes into contact with the feed plate 47.

As illustrated in FIG. 8, the paddle 4 rotates so that the feed plate 47 is directed upward from below on the nearly full state detection space 34 side.

The waste toner T is stirred by the stirring plate 44. The waste toner T is conveyed toward the nearly full state detection space 34 by the feed plate 47. While the feed plate 47 enters the nearly full state detection space 34, and the waste toner T is collected in the nearly full state detection space 34.

FIG. 9 is a sectional view taken along line A-A in FIG. 4, and illustrates a nearly full state. As illustrated in FIG. 9, the waste toner T is stirred by the stirring plate 44, and is conveyed toward the nearly full state detection space 34 by the feed plate 47. In this manner, it is possible to suppress variations in a height H of the liquid level of the collected waste toner T in the nearly full state. In a state where the height H of the liquid level of the collected waste toner T is substantially uniform, the liquid level of the waste toner T reaches a height of the sensor S.

According to the waste toner storage container 100, the feed plate 47 conveys the waste toner T toward the nearly full state detection space 34 in the second direction D2. In this manner, it is possible to prevent the waste toner T conveyed in the first direction D1 by the vertical conveyance blade 42 from being hardened after being pushed against the end portion in the first direction D1 of the waste toner storage container 100 without being conveyed in the second direction D2. Therefore, it is possible to suppress a difference in the amount of the waste toner T between the nearly full state detection space 34 and the toner storage space 21 due to a wall formed by the pushed and hardened waste toner T with respect to the nearly full state detection space 34, whereby the waste toner T is less likely to be conveyed to the nearly full state detection space 34. Therefore, the amount of the waste toner T inside the waste toner storage container 100 can be accurately detected.

The feed plate 47 protrudes from the outer peripheral surface 46 of the shaft 41 to such an extent that the feed plate 47 can enter the nearly full state detection space 34. Therefore, the feed plate 47 can directly convey the waste toner T to the nearly full state detection space 34.

The feed plate 47 has elasticity. Therefore, when the feed plate 47 discharges the waste toner T to the nearly full state detection space 34 after scraping the waste toner T, the waste toner T can be ejected and discharged to a position far from the toner storage space 21. If the height H of the liquid level of the waste toner T in the nearly full state detection space 34 is higher than the height of the liquid level in the toner storage space 21 and the amount of the waste toner T collected in the nearly full state detection space 34 is excessive, the feed plate 47 pushing the waste toner T elastically deforms, thereby preventing the feed plate 47 from conveying the waste toner T to the nearly full state detection space 34 more than necessary.

Some exemplary embodiments have been described herein. However, the embodiments are presented as examples, and are not intended to limit the scope of the invention. The exemplary embodiments can be implemented in various other forms. Various omissions, substitutions, and modifications can be made within the scope not departing from the concept of the invention. The embodiments and modifications are included in the scope and the concept of the invention, and are included in the appended claims and equivalents thereof.

Figure 10:
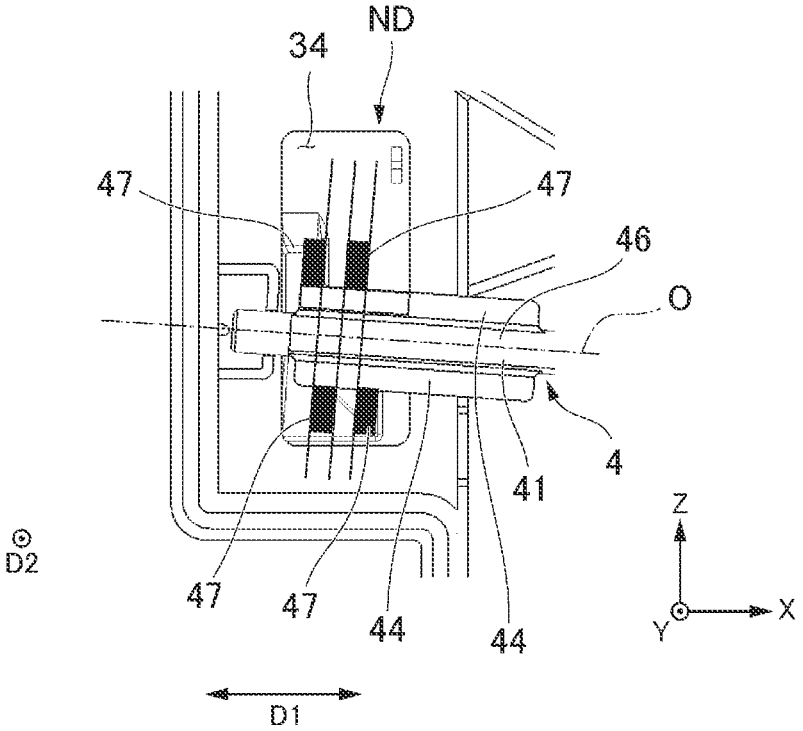
FIG. 10 is a view illustrating a modification example.

As illustrated in FIG. 10, a plurality of the feed plates 47 may be provided along the central axis O of the shaft 41. The feed plate 47 may be provided at the second position P2. The feed plates 47 may be alternately disposed at the first position P1 and the second position P2 along the central axis O so that the positions of the shaft 41 in the direction of the central axis O do not overlap each other. The feed plate 47 is disposed so that the positions in the direction of the central axis O do not overlap each other between the first position P1 and the second position P2. In this manner, the waste toner T moved in the direction of the central axis O after leaking from a trajectory of the feed plate 47 due to an operation of the feed plate 47 can be conveyed toward the nearly full state detection space 34 by another feed plate 47.

The feed plate 47 may not fit into the nearly full state detection space 34 when viewed in the second direction D2. In the feed plate 47, at least a portion of a rotation trajectory around the central axis O of the shaft 41 may overlap the nearly full state detection space 34 when viewed in the second direction D2.

The feed plate 47 may not protrude in the radial direction of the shaft 41, and may protrude in a direction inclined to the central axis O side of the shaft 41 instead of the radial direction of the shaft 41.

The vertical conveyance blade may not include the feed plate 47. The stirring plate 44 of the vertical conveyance blade 42 may have elasticity.

The nearly full state detection space ND may be provided in the vicinity of the center in the second direction D2 instead of the vicinity of the end portion in the second direction D2. The nearly full state detection space ND may be a space included in the toner storage space 21 without having a clear boundary with the toner storage space 21, instead of the groove-shaped space formed in the convex portion 33.

The first direction D1 and the second direction D2 may not be orthogonal to each other. The first direction D1 and the second direction D2 may intersect with each other.

The feed plate 47 and the stirring plate 44 may be separated in the direction of the central axis O of the shaft 41, or may be separated along the circumferential direction C around the central axis O of the shaft 41.

According to at least one embodiment described above, the feed plate 47 is provided. Accordingly, the amount of waste toner T inside the waste toner storage container 100 can be accurately detected regardless of a storage state of the waste toner T.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A waste toner storage container comprising:

a container body;

a toner storage chamber comprising:

an introduction port provided in the container body to receive waste toner, a first space storing the waste toner introduced through the introduction port, and extending in a first direction, and a second space disposed in an end portion of the first space in a second direction intersecting with the first direction, and communicating with the first space; and a paddle disposed in the first space, and extending along the first direction, and conveying the waste toner in the first direction; and a plate formed at a portion of the paddle located at the end of the first space, entering the second space by rotation of the paddle, and conveying the waste toner in the second direction.

2. The waste toner container according to claim 1, wherein the paddle has an elongated shaft, the plate has a flat plate shape protruding from the outer peripheral surface of the elongated shaft and extending along the central axis of the elongated shaft, in the flat plate shape, a length protruding from the outer peripheral surface of the elongated shaft is longer than a length extending along the central axis of the elongated shaft.

3. The waste toner container according to claim 2, wherein the plate has elasticity.

4. The waste toner container according to claim 1, wherein the second space is formed in an inner surface of the container body, and has a groove shape recessed in the second direction.

5. The waste toner container according to claim 1, wherein the paddle has an elongated shaft, in the plate, at least a portion of a rotation trajectory around the central axis of the elongated shaft overlaps an inside of the second space when viewed in the second direction.

6. The waste toner container according to claim 1, wherein the paddle has an elongated shaft, a plurality of the plates are formed along the central axis of the elongated shaft.

7. The waste toner container according to claim 1, wherein the toner storage chamber further comprises a plurality of introduction ports to receive waste toner.

8. The waste toner container according to claim 1, further comprising a sensor with a light emitting element and a light receiving element.

9. An image forming apparatus, comprising:
an image forming component; and
a waste toner storage container, comprising:
a container body;
a toner storage chamber comprising:
an introduction port provided in the container body to receive waste toner,
a first space storing the waste toner introduced through the introduction port, and extending in a first direction, and
a second space disposed in an end portion of the first space in a second direction intersecting with the first direction, and communicating with the first space; and
a paddle disposed in the first space, and extending along the first direction, and conveying the waste toner in the first direction; and
a plate formed at a portion of the paddle located at the end of the first space, entering the second space by rotation of the paddle, and conveying the waste toner in the second direction.

10. The image forming apparatus according to claim 9, wherein the toner storage chamber further comprises an additional introduction port to receive waste toner from a cleaner.

11. The image forming apparatus according to claim 9, wherein the toner storage chamber further comprises a plurality of introduction ports to receive waste toner from a corresponding plurality of image forming components.

12. The image forming apparatus according to claim 9, further comprising a plurality of image forming components.

13. The image forming apparatus according to claim 9, wherein the image forming apparatus is one of a printer, an MFP, and a copying machine.

14. The image forming apparatus according to claim 9, wherein the paddle has an elongated shaft, the plate has a flat plate shape protruding from the outer peripheral surface of the elongated shaft and extending along the central axis of the elongated shaft, in the flat plate shape, a length protruding from the outer peripheral surface of the elongated shaft is longer than a length extending along the central axis of the elongated shaft.

15. The image forming apparatus according to claim 14, wherein the plate has elasticity.

16. The image forming apparatus according to claim 9, wherein the second space is formed in an inner surface of the container body, and has a groove shape recessed in the second direction.

17. The image forming apparatus according to claim 9, wherein the paddle has an elongated shaft, in the plate, at least a portion of a rotation trajectory around the central axis of the elongated shaft overlaps an inside of the second space when viewed in the second direction.

18. The image forming apparatus according to claim 9, wherein the paddle has an elongated shaft, a plurality of the plates are formed along the central axis of the elongated shaft.

19. The image forming apparatus according to claim 9, wherein the toner storage chamber further comprises a plurality of introduction ports to receive waste toner.

20. The image forming apparatus according to claim 9, wherein the waste toner container further comprises a sensor with a light emitting element and a light receiving element.

* * * * *